United States Patent [19]

Johansson

[11] Patent Number: 4,813,923

[45] Date of Patent: Mar. 21, 1989

[54] CENTRIFUGAL SEPARATOR

[75] Inventor: Bo Johansson, Tullinge, Sweden

[73] Assignee: Alfa-Laval Separation AB, Tumba, Sweden

[21] Appl. No.: 149,087

[22] Filed: Jan. 27, 1988

[30] Foreign Application Priority Data

Feb. 9, 1987 [SE] Sweden ..... 8700475-0

[51] Int. Cl.[4] ..... B04B 3/08

[52] U.S. Cl. ..... 494/48; 494/40

[58] Field of Search ..... 494/48, 40, 27, 65; 210/781, 782

[56] References Cited

U.S. PATENT DOCUMENTS 2,873,910 2/1959 Steinacker ..... 494/40

3,482,771 12/1969 Thylefors ..... 494/65

3,777,972 12/1973 Kjellgren ..... 494/48

*Primary Examiner*—Robert W. Jenkins

*Attorney, Agent, or Firm*—Davis Hoxie Faithfull & Hapgood

[57] ABSTRACT

A centrifugal separator comprises a rotor having two separate coaxial rotor parts, means for axially interlocking these parts, and means arranged for discharging liquid from the separation chamber of the rotor so that the liquid pressure in the separation chamber varies. The separator is specifically characterized in that one of the rotor parts comprises two separate coaxial walls, an inner wall and an outer wall, that the inner wall is supported axially against the other rotor part, that the axially interlocking means connects the outer wall with the other rotor part, that a space is formed between the two walls, and that means are arranged to provide a force of substantially constant magnitude in the space between the walls during operation of the separator, which force acts to axially separate the walls.

14 Claims, 4 Drawing Sheets

CENTRIFUGAL SEPARATOR

The present invention relates to centrifugal separators of the type comprising a rotor having two separate coaxial rotor parts and means for axially interlocking these parts, a separation chamber positioned in the rotor between the coaxial rotor parts and adapted to receive a liquid mixture of different components which are to be separated during rotation of the rotor, and means for discharging a separated component from the separation chamber during rotation of the rotor, so that a varying liquid pressure arises in the separation chamber.

Centrifugal separators of this kind are described, for instance, in U.S. Pat. No. 3,482,771. An advantage with such known centrifugal separators is that when separating certain mixtures they can be opened intermittently during operation for discharging sludge containing solid particles, which is collected in the radially outermost part of the separation chamber. In this manner the operation of the separator is facilitated, since it is not necessary to dismantle the separate coaxial rotor parts for manual removal of collected sludge.

A drawback with the foregoing type of centrifugal separator is that the varying liquid pressure in the separation chamber which arises because of the intermittent discharge, results in varying stresses in the rotor and increases the risk of fatigue breakdown of the rotor. This risk is greatest at the portions of the rotor which have the highest stress concentrations during operation, principally at the means for axially interlocking the rotor parts, but also at the portions of the rotor which are weakened in consequence of discharge openings for sludge.

To avoid fatigue breakdown, centrifugal separators of the type described have had to be operated with limited rotation speed, with limited discharged volume of sludge per discharge occasion, with limited density of mixture, or with a combination of these limitations, so that the amplitude of the varying stresses was kept low. The separation capacity of this type of centrifugal separator for certain applications is therefore relatively limited.

The object of the present invention is to provide a centrifugal separator in which the above described limitations are substantially decreased or even eliminated so that the capacity of the separator can be increased by increasing rotation speed, discharge volume and the density of the mixture.

The foregoing and other objects are obtained, according to the invention, by means of a centrifugal separator of the kind initially described, characterized in that one of the rotor parts comprises two separate coaxial walls, an inner wall and an outer wall; that the inner wall is supported axially by the other rotor part; that said axially interlocking means connects the outer wall with the other rotor part; that a space is formed between the two walls; and that means are arranged to provide a force of substantially constant magnitude in the space between the walls during the operation of the separator, which force acts to axially separate the walls.

In a separator according to the invention the advantage is obtained that during rotation of the rotor a substantially constant state of strain is provided, at least in the axially interlocking means, independent of pressure variations in the liquid mixture in the separation chamber during discharge from the latter, provided that the force, which acts to axially separate the walls, is greater than the axial force caused by the pressure of the liquid mixture against the inner wall. Thus, varying stresses which would cause damage are eliminated in the axial interlocking means and adjacent rotor portions, and the risk of fatigue breakdown in these parts is substantially decreased. Of course, varying stresses do arise in the inner wall during discharge, but these are mainly in the form of compressive stresses, which make initiation and growth of cracks from superficial material deficiencies more difficult. Thus, the risk of fatigue breakdown in the inner wall is insignificant. If fatigue cracks are formed in the inner wall, the surrounding supporting rotor parts will prevent growth of such cracks to total breakdown. The risk of parts of the rotor wall flying out from the rotor because of fatigue breakdown, and thereby causing damage to the surroundings is substantially avoided.

If the force which acts to axially separate the walls is smaller than the axial force caused by the pressure of liquid mixture against the inner wall, varying tensile stresses in the interlocking means will arise during discharge. However, so long as the force acting to separate the walls is substantially greater than the axial force exerted by the portion of the liquid mixture remaining in the separation chamber during discharge, such tensile stresses will have low amplitudes, which minimizes the risk of fatigue breakdown in the interlocking means.

The means for providing the force acting to axially separate the walls is suitably provided by a liquid, which during rotation of the rotor generates a hydraulic pressure against the walls. Alternatively, it is possible to provide said force by means of springs arranged between the walls.

By and large, the intended technical effect according to the invention is obtained even if the coaxial walls are axially moveable relative to each other. However, in a preferred embodiment according to the invention the axially interlocking means is arranged to press the outer wall against the inner wall via cooperating shoulders, at least when the rotor is standing still, so that the inner wall is pressed against the other rotor part.

Further portions of the rotor (i.e., portions weakened by discharge openings) can be protected against fatigue breakdown by suitably choosing the portion for axial support of the inner wall against the other rotor part, so that during rotation of the rotor a substantially constant strain is created in said portions.

It is also possible to provide a substantially constant strain in both rotor parts during rotation of the rotor, except in the inner wall, by arranging the inner wall to be axially supported against the other rotor part centrally in the rotor, i.e., via a central axial column or via a plurality of conical separation plates arranged in the separation chamber around the shaft of the rotor.

The invention will be described in more detail with reference to the accompanying drawing, in which.

In the figures identical rotor parts have been provided with the same reference numerals.

Figure 1:
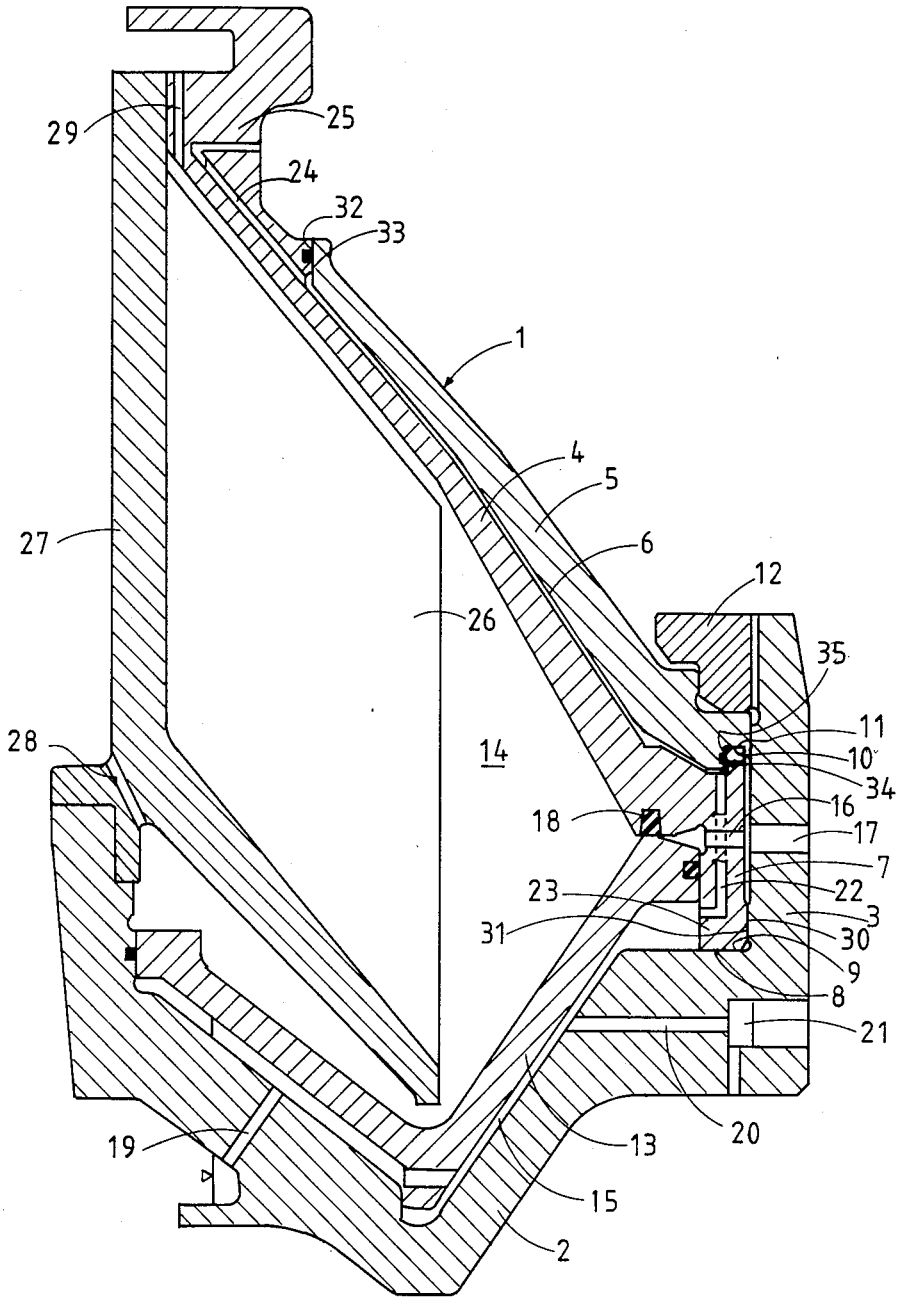
FIG. 1 is a view in vertical section of a rotor in accordance with a preferred embodiment of the invention.
Figure 2:
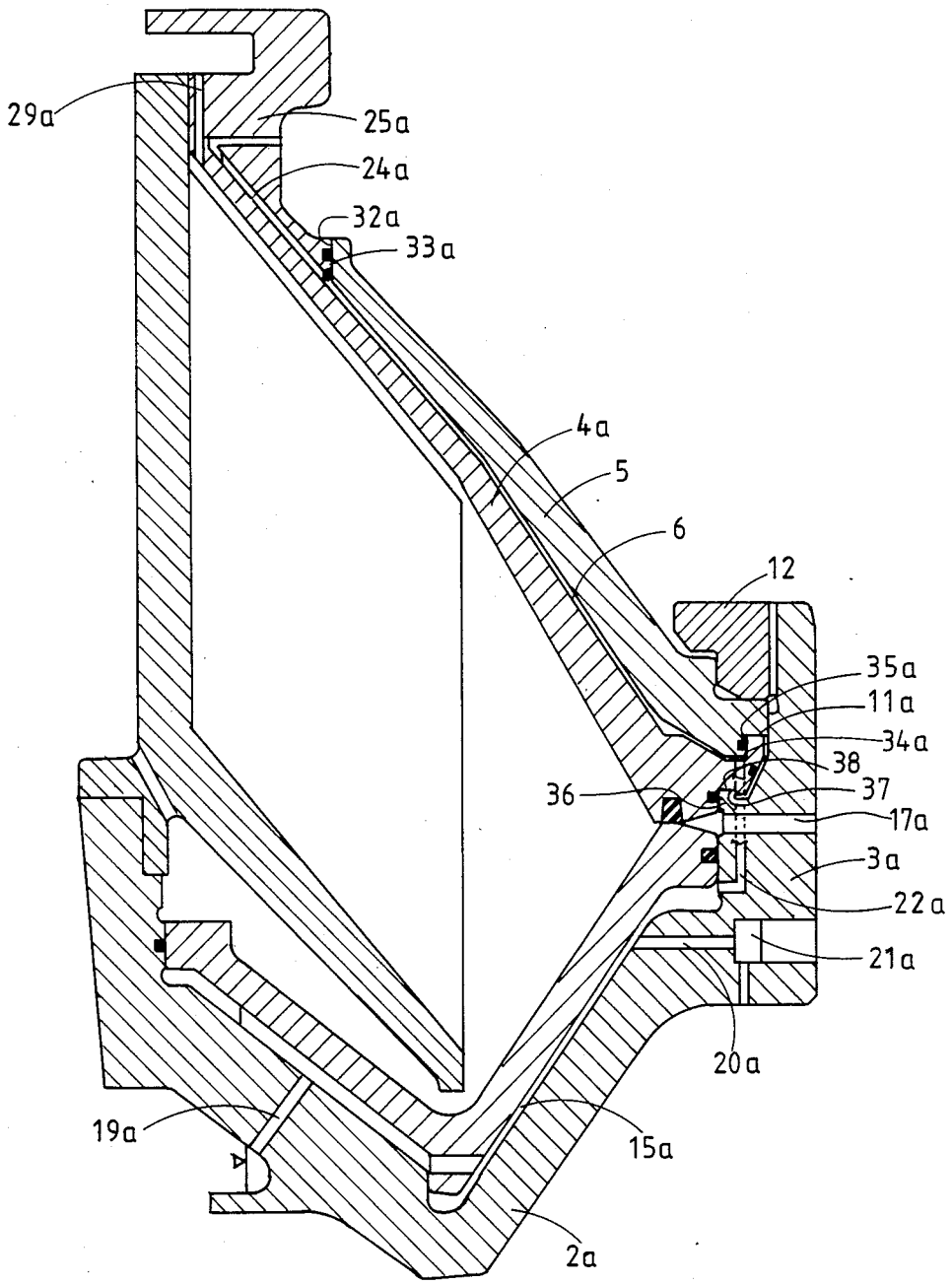
FIGS. 2 to 4 show, in vertical section, three alternative embodiments of rotors in accordance with the invention.
Figure 3:
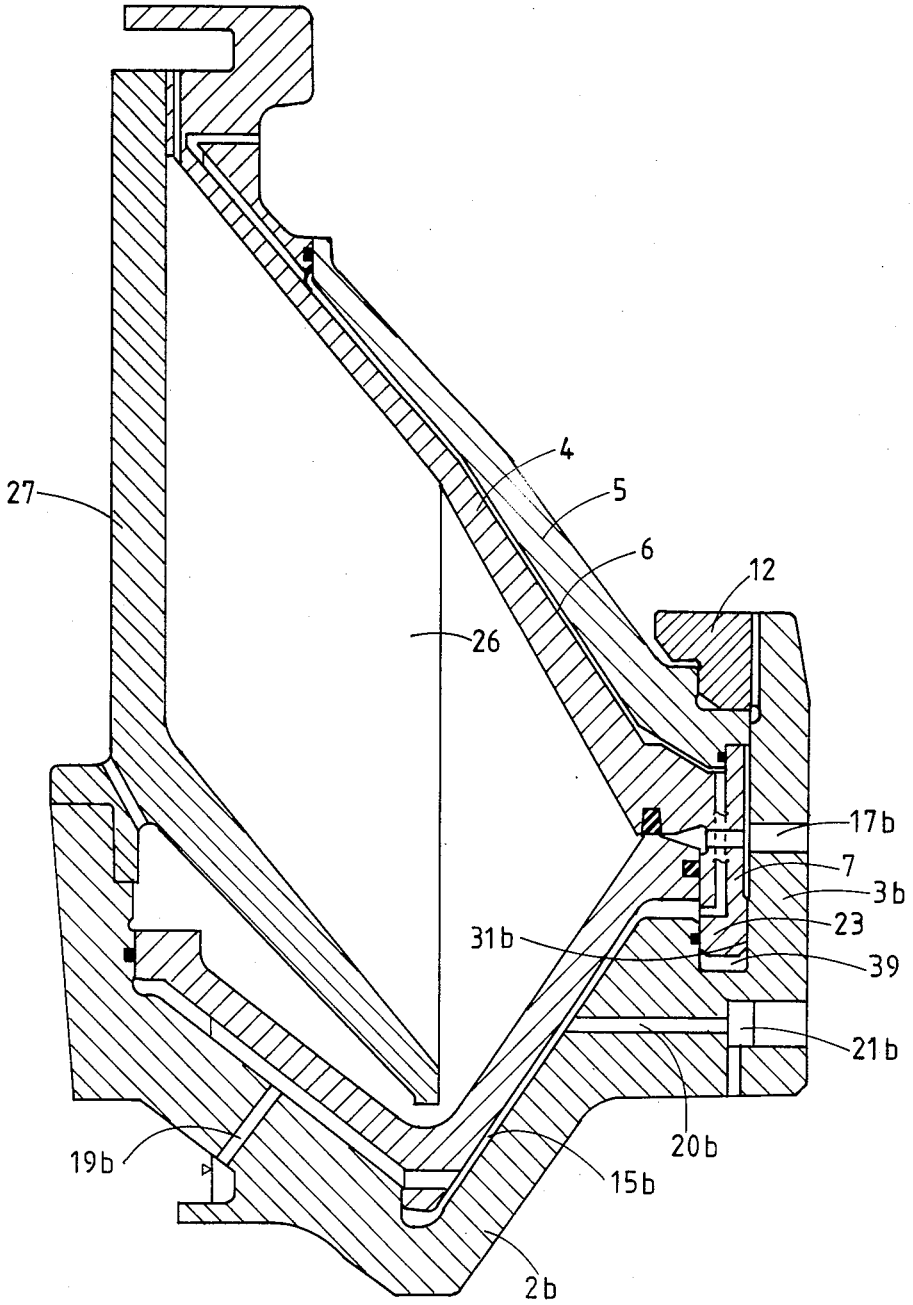

In FIGS. 2 and 3, parts which correspond to parts shown in FIG. 1, but which are modified with respect to the parts of FIG. 1, have additional references "a" and "b", respectively. These parts have the same technical function as corresponding rotor parts and details in the rotor according to FIG. 1. In the same way the additional reference "c" in FIG. 4 designates corresponding rotor parts and details with respect to the rotor of FIG. 2.

In FIG. 1 there is shown a rotor comprising two separate coaxial rotor parts, an upper part 1 and a lower part 2. The upper rotor part 1 has a substantially conical shape and connects, through its radially outer portion, to the radially outer portion of the lower rotor part, so that a space is formed between the rotor parts 1, 2. The radially outer portion of the lower rotor part comprises a cylindrical circumferential portion 3, which surrounds the radially outer portion of the upper rotor part 1. The upper rotor part 1 consists of two separate coaxial walls, an inner wall 4 and an outer wall 5, which form a space 6 between them. The inner wall 4 is axially extended by means of a cylindrical circumferential portion 7, which extends axially along the inner side of the circumferential portion 3 of the lower rotor part and which has a shoulder 8 which bears against a shoulder 9 of the circumferential portion 3 of the lower rotor part 2 and axially supports the inner wall 4 of the upper part 1. The outer wall 5 is supported at its radially outer portion by a shoulder 10 bearing axially against a cooperating shoulder 11 of the inner wall 4.

A locking ring 12 is engaged by means of threads with the inner side of the circumferential portion 3 in the vicinity of its free end and presses axially against the outer side of the outer wall 5, so that the outer and inner walls 5 and 4 and the lower rotor part 2 are pressed against each other via the shoulders 8–11.

The space between the rotor parts 1, 2 is divided by a plate shaped slide valve 13 into a separation chamber 14, which is formed between the upper rotor part and the slide valve 13, and a closing chamber 15 formed between the lower rotor part 2 and the slide valve 13. The closing chamber 15 extends somewhat less radially outwardly than does the space 6 between the walls 4, 5.

In the circumferential portions 7 and 3 of the inner wall 4 and the lower rotor part 2, there are discharge openings 16 and 17, respectively, for sludge from the separation chamber 14, the discharge openings 16 being aligned with the discharge opening 17. The slide valve 13 is axially moveable in the rotor between a lower position, in which a passage is formed between the separation chamber 14 and the discharge openings 16, 17, and an upper position (shown in FIG. 1) in which the slide valve 13 seals via an annular gasket 18 against the inner wall 4, so that said passage is closed.

The closing chamber 15 has a central inlet 19, and a peripheral outlet 20 situated in the lower rotor part 2. The outlet 20 is provided with a liquid controlled operating valve 21 to close and open the outlet 20. The closing chamber 15 communicates with the space 6 between the inner and outer walls 4, 5 via channels 22 extending through the circumferential portion 7 of the inner wall. The openings of the channels 22 in the closing chamber 15 are situated in a part 23 of the circumferential portion 7 of the inner wall, which has an exposed surface in the closing chamber. The space 6 communicates with the external surroundings of the rotor via an air channel 24, which extends through a central portion 25 of the inner wall 4.

A plurality of coaxial separation plates 26 are situated in the separation chamber 14 and are carried by a central so-called distributor 27, which rests on the lower rotor part 2. The separation chamber 14 has an inlet 28 in the distributor 27 in the vicinity of the lower rotor part 2 and one or more outlets 29 in the central portion 25 of the inner wall 4.

The inner wall 4 is radially guided at its circumference by the circumferential portion 7 bearing against the circumferential portion 3 of the lower rotor part. To this end, said circumferential portions 7 and 3 are provided with circular cylindrical surfaces 30 and 31, respectively, situated below the discharge openings 16 and 17. The outer wall 5 is radially guided against the inner wall 4 via cooperating cylindrical surfaces 32 and 33 situated at the radially innermost part of the outer wall 5, and via cooperating cylindrical surfaces 34 and 35 situated at the radially outermost part of the outer wall 5.

The centrifugal separator according to FIG. 1 operates in the following way:

When starting the centrifugal separator the outlet 20 is closed from the closing chamber 15 by means of the operating valve 21, whereafter closing liquid is supplied to the closing chamber through the inlet 19. Part of the closing liquid streams from the closing chamber 15 through the channels 22 into the space 6 between the walls 4, 5 and fills this to the level corresponding to the head of the liquid in the closing chamber 15. Alternatively, the space 6 between the walls may be filled with liquid which is supplied to the space from outside the rotor through a separate inlet (not shown), which may be formed between the inner wall 4 and the radially innermost portion of the outer wall 5. In this case there is no need for the channels 22 between the closing chamber and the space 6.

Because of the rotation of the rotor a hydraulic pressure is created in the closing chamber 15, which means that the slide valve 13 moves axially upwards in the rotor to close the passage between the separation chamber 14 and the discharge openings 16, 17. In addition, a hydraulic pressure is created in the space 6 between the walls 4, 5, which means that the inner wall 4 is affected by an axially downwardly directed force. The space 6 has a radial extension, such that said axially downwards directed force is greater than the axially upwards directed force of the slide valve 13 against the inner wall 4. The resulting axially downwards force acts via the circumferential portion 7 of the inner wall 4 against the shoulder 9 of the circumferential portion 3 of the lower rotor part 2. Even at this early stage, when there is liquid only in the closing chamber 15 and the space 6, the outer wall 5, the locking ring 12 and the circumferential portion 3 of the lower rotor part 2 have achieved full operational load and deformation.

By supplying the liquid mixture to be separated to the separation chamber 14 via the inlet 28, a hydraulic pressure arises in the separation chamber acting against the slide valve 13 and the inner wall 4. By this means the axially upwardly directed force of the slide valve against the inner wall 4 is decreased. However, the decrease of the axial force against the inner wall 4 is exactly compensated for by the additional axial force caused by the pressure of the liquid mixture against the inner wall 4. Thus, the above mentioned downwardly directed axial force from the circumferential portion 7 of the inner wall against the shoulder 9 of the lower rotor part 2 will remain unchanged. Only the inner wall 4 and the slide valve 13 will have changed states of strain, while the outer wall 5, the locking ring 12 and the lower rotor part 2 will have unchanged states of strain.

During complete or partial discharge of the content of the separation chamber 14, closing liquid is removed from the closing chamber 15 by means of the operating valve 21 and liquid is removed from the separation chamber 14 via the discharge openings 16, 17 so that the free liquid surfaces in the respective chambers 14 and 15 are displaced outwardly towards a larger radius in the rotor. Non-return valves or throttles in the channels 22, not shown in the drawings, make it certain that the liquid in the space 6 between the walls 4, 5 will not stream out of the rotor via the channels 22, the closing chamber 15 and the outlet 20 during the short discharge process. Thus, the state of strain in the outer wall 5, the locking ring 12 and the circumferential portion 3 of the lower rotor part at the discharge opening 17 will not be affected.

During discharge the hydraulic pressures in the separation chamber 14 and the closing chamber 15 are substantially decreased, which results in an increased downwardly directed axial force from the circumferential portion 7 of the inner wall against the shoulder 9 of the circumferential portion 3 of the lower rotor part 2, since the hydraulic pressure in the space 6 between the walls 4, 5 is substantially unchanged. Thus, during discharge varying stresses are created in the circumferential portion 7 of the inner wall, which is weakened by the discharge openings 16. However, said varying stresses mainly occur in the form of compressive stresses, which make initiation and growth of fatigue cracks more difficult.

Because of the fact that the circumferential portion 7 of the inner wall 4 is guided by contact with the circular cylindrical surfaces 30 and 31, of the circumferential portion 3 of the lower rotor part, which surfaces are situated in the lower part 23 of the circumferential portion 7 and in the vicinity of the transition section of the circumferential portions 3 to the stiff bottom portion of the lower rotor part, a favorable radial guidance of the inner wall relative to the lower rotor part is achieved during operation of the separator, which decreases the risk of damaging vibrations in the rotor. The play between the circular cylindrical surfaces 30 and 31, which has to exist to enable mounting the inner wall 4 on the lower rotor part 2, will decrease during operation of the separator, since the dynamic forces acting against the circumferential portions 3 and 7 during rotation of the rotor will cause a greater outwardly directed radial displacement of the relatively weak lower part 23 of the circumferential portion 7 than of the relatively stiff part of the circumferential portion 3 situated in the vicinity of the bottom portion of the rotor part 2.

In FIG. 2 there is shown a rotor which differs from the rotor shown in FIG. 1 in that the inner wall **4*a* lacks a downwardly extended, axial circumferential portion. The circumferential portion 3*a* of the lower rotor part 2*a* is provided with an annular projection 36 extending axially upwardly into an annular recess 37 in the inner wall 4*a* to radially guide the latter relative to the circumferential portion 3*a*. The inner wall 4*a* is supported by the bottom of the recess 37 bearing against a shoulder 38 on the projection 36, the bottom of the recess 37 being situated axially between the discharge openings 17*a* in the circumferential portion 3*a* and the locking ring 12. Thus, discharge openings need only be arranged in a simple conventional manner in the circumferential portion 3*a* of the lower rotor part 2*a*. However, the circumferential portion 3*a* at the discharge opening 17*a* will not have constant state of strain during operation of the separator. Varying tensile stresses will arise in said circumferential portion 3*a* in connection with intermittent discharge of sludge. The design of the channels 22*a* between the closing chamber 15*a* and the space 6 between the walls 4*a* and 5 will be more complicated than in the rotor according to FIG. 1, since the channels 22*a* extend through both the circumferential portion 3*a* and the inner wall 4*a*. This requires an extra gasket arrangement at the transition sections of the channels 22*a* between the circumferential portion 3*a* and the inner wall 4*a***.

In FIG. 3 there is shown a rotor which differs from the rotor shown in FIG. 1 in that the lower rotor part **2*b* is provided with an annular recess 39, in which the end part 23 of the circumferential portion 7 of the inner wall is arranged axially movable. The inner wall 4 is supported by bearing against the lower rotor part 2*b* via the coaxial separation plates 26 and distributor 27. Thus, a constant state of strain in the outer wall 5, the locking ring 12 and the circumferential portion 3*b* of the lower rotor part 2*b*** arises when operating the separator.

Figure 4:
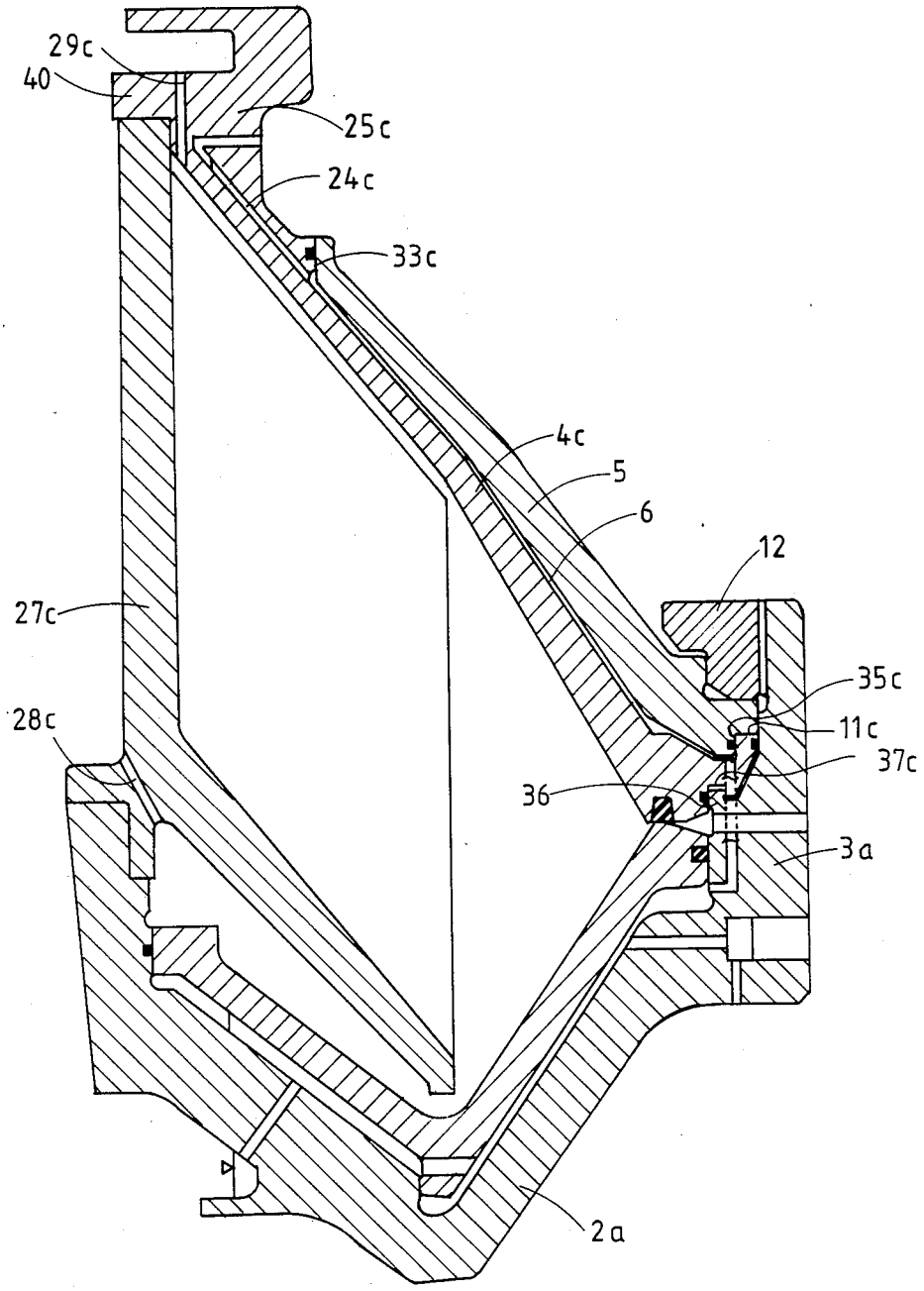

In FIG. 4 there is shown a rotor which differs from the rotor shown in FIG. 2 by a different design of the distributor **27*c* and the inner wall 4*c*. The latter is supported by bearing against the lower rotor part 2*a* via the distributor 27*c* by means of a central portion 40, which abuts the upper end of the distributor. The recess 37*c* of the inner wall 4*c* is designed to have a depth such that a gap is formed between the bottom of the recess and the projection 36. Thus the circumferential portion of the inner wall 4*c* is not supported by the circumferential portion 3*a* of the lower rotor part. Also in this embodiment of the rotor a constant state of strain arises in the outer wall 5, the locking ring 12 and the circumferential portion 3*a* of the lower rotor part 2*a*** when operating the separator.

The rotor according to FIG. 4 may be given another alternative design by providing its inner wall with a downwardly extended, axial circumferential portion as in the arrangement described above for the rotor according to FIG. 3.

The invention is also applicable to centrifugal separators which lack an inner axially moveable slide valve for closing and opening the discharge openings. For instance, the discharge openings may be intermittently opened by means of a device situated outside the separation chamber. In this case liquid may suitably be supplied to a space between the coaxial walls from outside the rotor via an inlet formed between the inner wall and the radially innermost portion of the outer wall.

All of the embodiments of the invention shown in the drawing are provided with interlocking means in the form of a threaded locking ring, which interlocks the radially outer portion of the outer wall with the radially outer circumferential portion of the lower rotor part. However, as a possible alternative the interlocking means may be arranged centrally to interlock a radially innermost portion of the outer wall with a central column in the rotor, which is connected with the lower rotor part. In this alternative also the interlocking means will have a constant state of strain during operation of the separator. The interlocking means need not comprise a separate member but may be constituted by threaded portions of the respective rotor parts 1 and 2.

What is claimed is:

1. In a centrifugal separator comprising a rotor having two separate coaxial rotor parts and means for axially interlocking said parts, a separation chamber between the coaxial rotor parts adapted to receive a liquid mixture of components to be separated and means for discharging a separated component from the separation chamber during rotation of the rotor, so that a varying liquid pressure is generated in the separation chamber, the improvement which comprises separate coaxial inner and outer walls in one of said rotor parts, a space between the walls, said inner wall being supported axially by the other rotor part, and said interlocking means connecting the outer wall with the other rotor part; and means for providing a force of substantially constant magnitude in the space between the walls during operation of the separator, said force acting to axially separate the walls.

2. The centrifugal separator claimed in claim 1 wherein said means for supplying said force comprises means for supplying liquid to said space during operation of the separator.

3. The centrifugal separator claimed in claim 1 and comprising cooperating shoulders on said outer and inner walls, said axially interlocking means, at least when the rotor is standing still, pressing the shoulder of the outer wall against the shoulder of the inner wall so that the inner wall is pressed against the other rotor part.

4. The centrifugal separator claimed in claim 1 wherein the other rotor part has a circumferential portion which surrounds a circumferential portion of said inner wall.

5. The centrifugal separator claimed in claim 4, in which said axially interlocking means connects the outer wall with the circumferential portion of the other rotor part.

6. The centrifugal separator claimed in claim 4 in which the means for discharging a separated component comprises discharge openings in the circumferential portion of the other rotor part and an axially movable slide valve situated between the rotor parts and adapted for opening and closing the discharge openings.

7. The centrifugal separator claimed in claim 6 and comprising a closing chamber formed between the slide valve and the other rotor part and a channel connecting said closing chamber with the space between the inner and outer walls.

8. The centrifugal separator claimed in claim 7 wherein said channel extends through the circumferential portion of the other rotor part.

9. The centrifugal separator claimed in claim 6 in which the circumferential portion of the inner wall extends axially past the discharge openings in the circumferential portion of the other rotor part and comprising discharge openings in the circumferential portion of the inner wall aligned with the discharge openings in the other rotor part.

10. The centrifugal separator claimed in claim 9 and comprising a closing chamber formed between the slide valve and the other rotor part and at least one channel extending through the circumferential portion of the inner wall and connecting said closing chamber with the space between the inner and outer walls.

11. The centrifugal separator claimed in claim 9 and comprising a shoulder on the inner wall at the part of its circumferential portion which extends past the discharge openings in the circumferential portion of the other rotor part, and a shoulder on the circumferential portion of the other rotor part bearing against the shoulder of the inner wall to axially support the inner wall, the discharge openings in said circumferential portion of the other part being situated axially between said interlocking means and said shoulders.

12. The centrifugal separator claimed in claim 4 comprising a shoulder at the circumferential portion of the other rotor part supporting the inner wall.

13. The centrifugal separator claimed in claim 1 wherein said rotor has a distributor and comprising a plurality of conical separation plates arranged in the separation chamber coaxially around the distributor, the inner wall being supported on the other rotor part via said separation plates.

14. The centrifugal separator claimed in claim 1 and comprising a central axial distributor, the inner wall being supported axially against the other rotor part via said distributor.

* * * * *